US005769065A

United States Patent [19]

Hurd

[11] Patent Number: 5,769,065

[45] Date of Patent: Jun. 23, 1998

[54] BOW-ATTACHED, ARROW LAUNCHING APPARATUS

[76] Inventor: David L. Hurd, Rte. 3, Box 789A, Tazewell, Va. 24651

[21] Appl. No.: 873,228

[22] Filed: Jun. 11, 1997

[51] Int. Cl.[6] ..... F41B 5/00

[52] U.S. Cl. ..... 124/24.1; 124/86

[58] Field of Search ..... 124/23.1, 24.1, 124/25.6, 44.5, 86, 88

[56] References Cited

U.S. PATENT DOCUMENTS

| | | | |
|---|---|---|---|
| 4,027,645 | 6/1977 | Damron | 124/24.1 |
| 4,146,009 | 3/1979 | Adams | 124/88 |
| 4,290,407 | 9/1981 | Damron | 124/44.5 |
| 4,732,133 | 3/1988 | Chattin | 124/24.1 |
| 4,829,974 | 5/1989 | Anderson | 124/24.1 |
| 5,263,465 | 11/1993 | Anderson | 124/24.1 |
| 5,390,654 | 2/1995 | Perkins | 124/24.1 |
| 5,465,705 | 11/1995 | Baeseman | 124/88 |
| 5,520,163 | 5/1996 | Hurd | 124/24.1 |
| 5,553,597 | 9/1996 | Sparks | 124/44.5 |
| 5,671,723 | 9/1997 | Goff et al. | 124/44.5 X |

*Primary Examiner*—John A. Ricci

[57] ABSTRACT

An arrow launching apparatus includes a bow attachment assembly and an arrow guide assembly. The front end of the arrow guide assembly is connected to the bow attachment assembly such that the arrow guide assembly is oriented perpendicularly with respect to the bow attachment assembly. The arrow guide assembly is adapted to receive an arrow for launching and includes a pair of longitudinally extensible and retractable front-end guide track assemblies located at the front end of the arrow guide assembly. Each of the front-end guide track assemblies includes a front telescopic segment and a rear telescopic segment. A plurality of spacer supports are connected to the front-end guide track assemblies and support the front-end guide track assemblies a predetermined distance from one another. A pair of transversely rotatable joint assemblies are provided. A first elastic resilient member is connected between the front telescopic segment and a front joint link for urging the front telescopic segment and the rear telescopic segment to a retracted orientation with respect to each other. A pair of transversely rotatable rear-end guide track assemblies are provided, wherein each rear-end guide track assembly is connected to a respective joint assembly. A bow string guide assembly is connected between the rear-end guide track assemblies at the rear end of the arrow guide assembly. The front joint link includes a stop portion located between the rear telescopic segment and a rear-end housing tube of a respective rear-end guide track assembly.

10 Claims, 4 Drawing Sheets

14
68
10
24
22
7

14
3
3
28
22
24
30
33
35
24
63
68
10

FIG 5
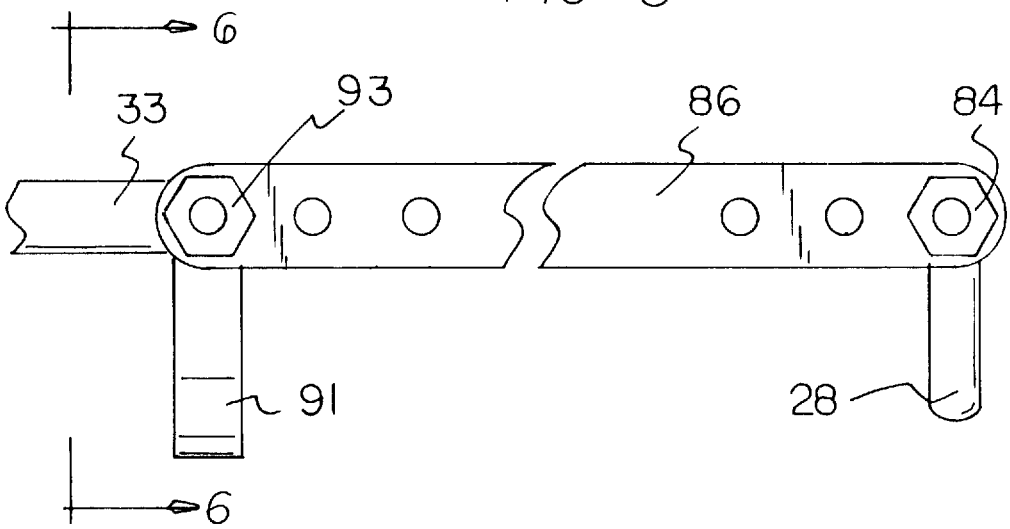
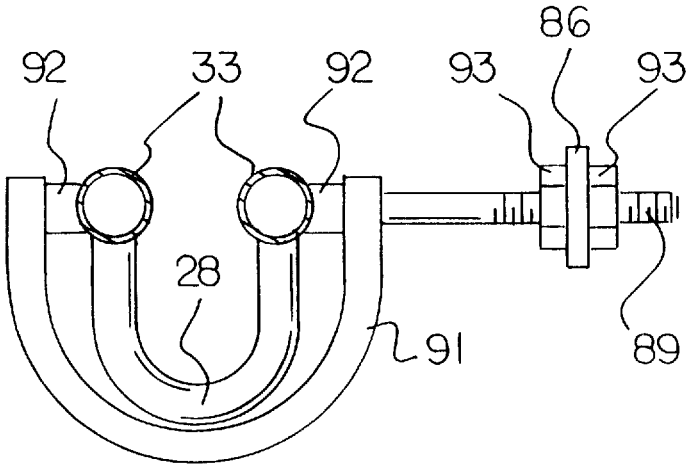
FIG 6

FIG 7
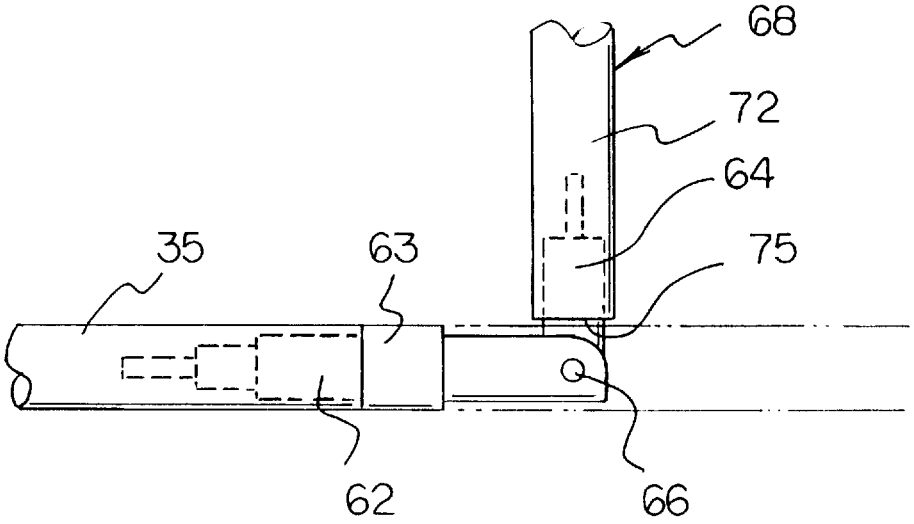
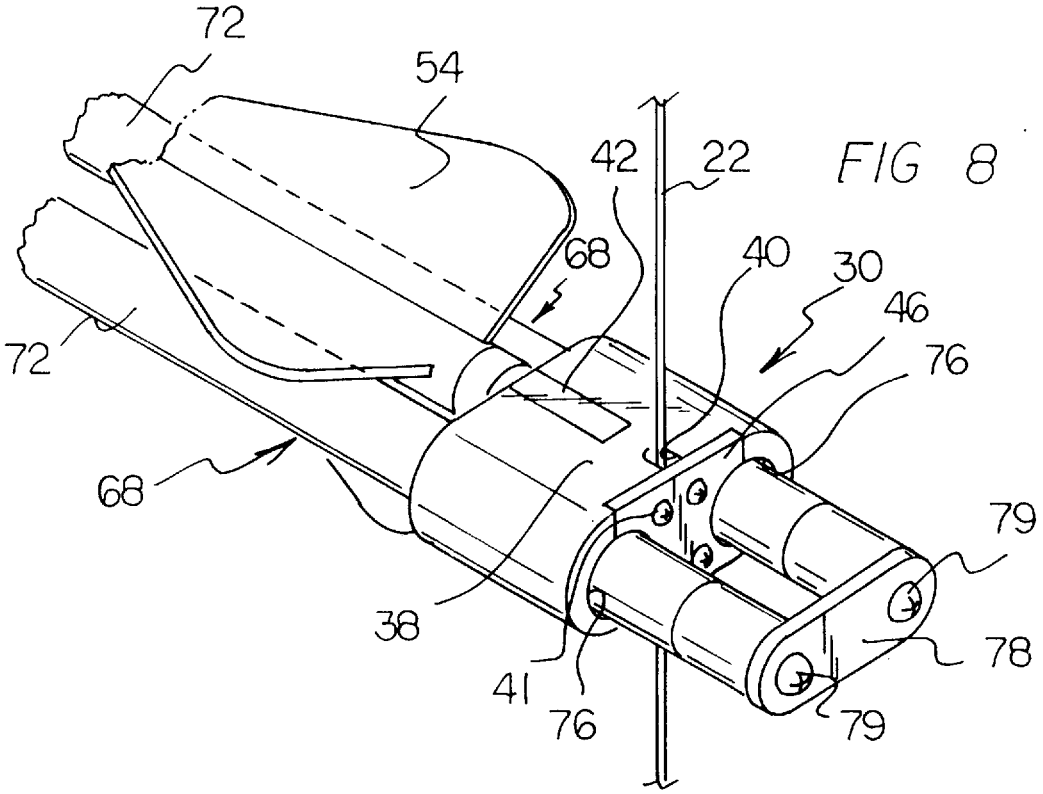
FIG 8

BOW-ATTACHED, ARROW LAUNCHING APPARATUS

BACKGROUND OF THE INVENTION

1. Field of the Invention

The present invention relates generally to bows and arrows and, more particularly, to an attachment to a bow especially adapted for launching arrows.

2. Description of the Prior Art

The invention described herein is an improvement of the bow-attached, arrow launching apparatus by the same inventor, David L. Hurd, and disclosed in U. S. Pat. No. 5,520,163, incorporated herein by reference. The present invention continues to retain the combination of desirable features set forth in U. S. Pat. No. 5,520,163. More specifically, with the present invention, the following combination of desirable features are retained: (1) employs arrows that are shorter than conventional length; (2) provides a bow and bow string that can be sufficiently stretched to effectively propel a shorter-than-conventional-length arrow; (3) is able to readily convert a conventional bow into a novel bow that can be employed to launch shorter-than-conventional-length arrows; (4) provides arrows which permit the arrows to propelled by a bow string without employing a slot at the rear ends of the arrows; (5) permits pulling back the rear end of an arrow and the bow string without using a pinching and pulling action on the rear end of the arrow; (6) provides a track for launching a shorter-than-conventional-length arrow wherein the track has a relatively short length for storage purposes; and (7) provides a launching device for a shorter-than-conventional-length arrow that can be employed with a vertically oriented bow.

In U. S. Pat. No. 5,520,163, the overall length of the device is determined solely by the degree of extension between the respective telescopic members. With, the present improvement, however, the inventor provides an improved bow-attached, arrow launching apparatus in which to overall length of the device is determined by two contributing factors. The first determiner of overall length is the relationship between two telescopic members, and the second determiner of overall length is the length of the folding rear-end guide track assembly.

Also, with the present invention, an improved bow-attached, arrow launching apparatus is provided in which a bracket member can be used as a support for a plurality of arrows.

In addition, with the present invention, a bridge block is provided that includes tube-reception channels for receiving rear-end guide track assemblies that can fold up when not in use.

In addition to the desirable mentioned above provided by U. S. Pat. No. 5,520,163, the present improvement provides the following additional desirable features: (1) provides a first determiner of overall length which relies on the relationship between two telescopic members, and provides a second determiner of overall length which relies on the length of a folding rear-end guide track assembly; and (2) a bracket member can be used as a support for a plurality of arrows. The foregoing additional desired characteristics are provided by the unique improved bow-attached, arrow launching apparatus of the present invention as will be made apparent from the following description thereof. Other advantages of the present invention over the prior art also will be rendered evident.

SUMMARY OF THE INVENTION

To achieve the foregoing and other advantages, the present invention, briefly described, provides a bow-attached, arrow launching apparatus for launching an arrow that has a head portion which has a head width and that has a tail portion which has a tail width. The apparatus includes a bow attachment assembly adapted to be attached perpendicularly to a bow and an arrow guide assembly which includes a front end, a midportion, and a rear end. The front end is connected to the bow attachment assembly such that the arrow guide assembly is oriented perpendicularly with respect to the bow attachment assembly. The rear end is adapted to contact a bow string. The arrow guide assembly is adapted to receive an arrow for launching from the arrow guide assembly. The arrow guide assembly includes a pair of longitudinally extensible and retractable front-end guide track assemblies located at the front end of the arrow guide assembly.

Each of the pair of longitudinally extensible and retractable front-end guide track assemblies includes a front telescopic segment and a rear telescopic segment, adapted to be arranged in either a longitudinally retracted orientation or a longitudinally extended orientation.

A plurality of spacer supports are connected to the front-end guide track assemblies and are supported by the front-end guide track assemblies a predetermined distance from one another. A first spacer support is connected to the bow attachment assembly.

A pair of transversely rotatable joint assemblies are provided, wherein each joint assembly includes a front joint link fitted into a respective rear telescopic segment, and wherein each joint assembly includes a rear joint link and a hinge portion connected between the front joint link and the rear joint link. A first elastic resilient member is connected between the front telescopic segment and the front joint link for urging the front telescopic segment and the rear telescopic segment to a retracted orientation with respect to each other. A pair of transversely rotatable rear-end guide track assemblies are provided, wherein each rear-end guide track assembly is connected to a respective joint assembly. A bow string guide assembly is connected between the rear-end guide track assemblies at the rear end of the arrow guide assembly. Each rear-end guide track assembly includes a rear-end housing tube which has an internal diameter greater than an outer diameter of the rear joint link, the hinge portion, and a portion of the front joint link. An end bushing is attached to a rearmost end of the rear-end housing tube, and a second elastic resilient member is disposed within the rear-end housing tube and is connected between the end bushing and a respective rear joint link. The front joint link includes a stop portion located between the rear telescopic segment and the rear-end housing tube.

The predetermined distance spaced between the front-end guide track assemblies and the rear-end guide track assemblies is less than the head width of the head portion of the arrow and is less than the tail width of the tail portion of the arrow.

Each of the front-end guide track assemblies further includes a recoil spring assembly connected between the first elastic resilient member and the front joint link of a respective joint assembly for cushioning an impact between the front joint link and the first elastic resilient member when the rear telescopic segment moves towards the front telescopic segment when the telescopic segments move from a longitudinally extended orientation to a longitudinally retracted orientation. The recoil spring assembly includes a cushion member between a spring member and the first elastic resilient member.

The bow string guide assembly includes a bridge block connected between the rear-end guide track assemblies. The bridge block includes a groove adapted for receiving the bow string. The groove permits the bow string to move against the bridge block without is grabbed by the bridge block. A cover member adapted to cover the groove when a bow string is retained in the groove, and a magnet is connected to the bridge block. The bridge block includes a pair of tube-reception channels for receiving the rear-end guide track assemblies.

The bow attachment assembly includes a threaded bolt, a first nut and a first washer placed on the threaded bolt, a second washer and a second nut placed on the threaded bolt.

The bow attachment assembly further includes a longitudinally oriented bracket member supported by the threaded bolt, and a bracket support assembly is connected to the bracket member. The bracket support assembly includes a threaded bolt portion connected to the bracket member and a spacer support portion connected to the threaded bolt portion. The spacer support portion includes a U-shaped spacer strut connected to the threaded bolt portion, and a pair of pads, wherein each pad is connected to the U-shaped spacer strut at an end portion of the U-shaped spacer strut.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining a preferred embodiment of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

It is therefore an object of the present invention to provide a new and improved bow-attached, arrow launching apparatus which has all of the advantages of the prior art and none of the disadvantages.

It is another object of the present invention to provide a new and improved bow-attached, arrow launching apparatus which may be easily and efficiently manufactured and marketed.

It is a further object of the present invention to provide a new and improved bow-attached, arrow launching apparatus which is of durable and reliable construction.

An even further object of the present invention is to provide a new and improved bow-attached, arrow launching apparatus which is susceptible of a low cost of manufacture with regard to both materials and labor, and which accordingly is then susceptible of low prices of sale to the consuming public, thereby making such improved bow-attached, arrow launching apparatus available to the buying public.

Still yet a further object of the present invention is to provide a new and improved bow-attached, arrow launching apparatus which a first determiner of overall length is the relationship between two telescopic members, and the second determiner of overall length is the length of the folding rear-end guide track assembly.

Still another object of the present invention is to provide a new and improved bow-attached, arrow launching apparatus that a bracket member can be used as a support for a plurality of arrows.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein:

FIG. 5 is an enlarged side view of the portion of the embodiment of the invention shown in FIG. 3 taken along line 5—5 thereof.

FIG. 6 is a front view of the portion of the embodiment of the invention shown in FIG. 5 taken along line 6—6 thereof.

FIG. 7 is an enlarged side view of the portion of the embodiment of the invention shown in circled region 7 in FIG. 1.

FIG. 8 is an enlarged perspective view of the portion of the embodiment of the invention shown in circled region 8 in FIG. 3.

DESCRIPTION OF THE PREFERRED EMBODIMENT

Figures 1, 2:
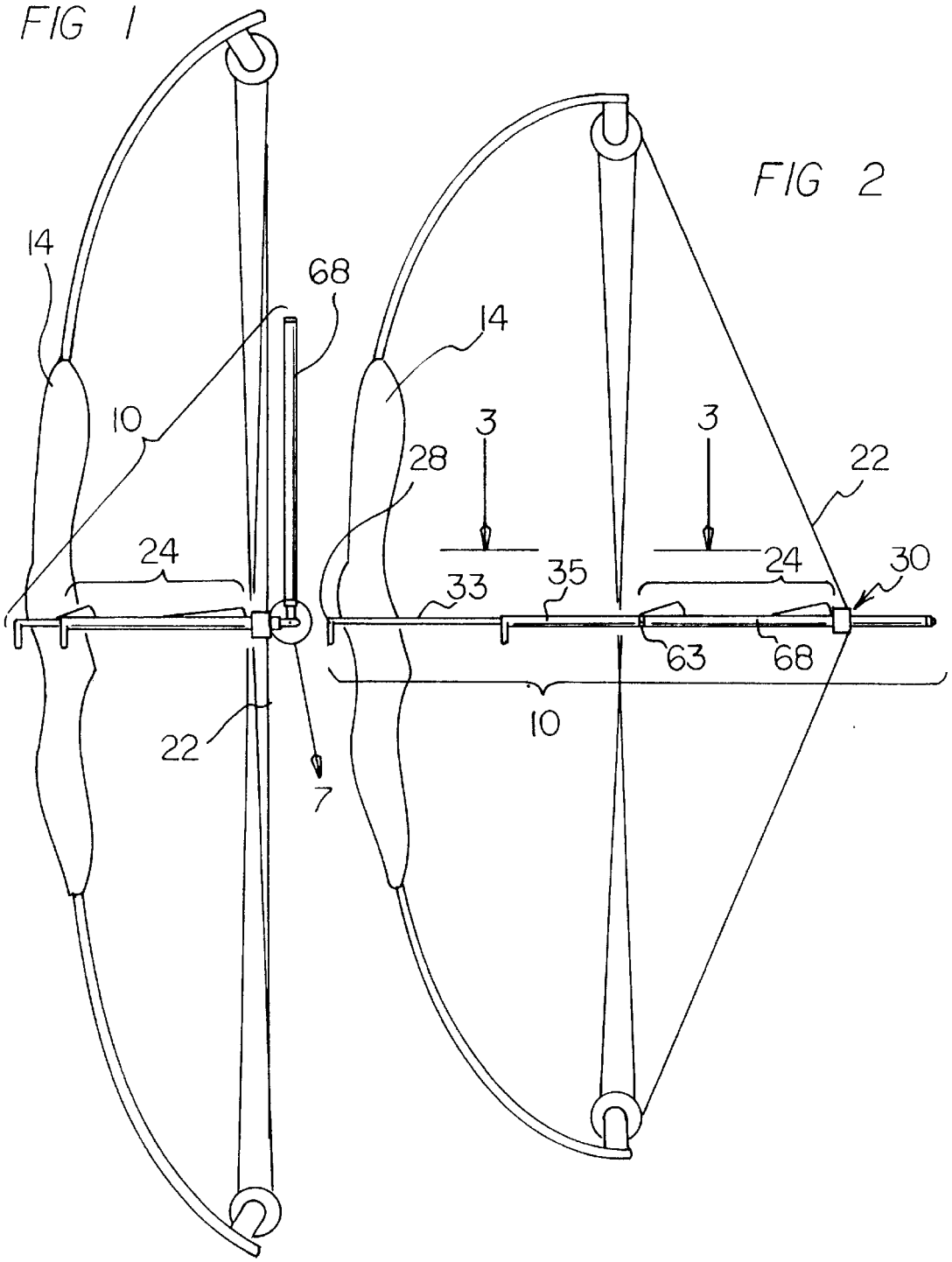
FIG. 1 is a side view showing a preferred embodiment of the improved bow-attached, arrow launching apparatus of the invention, in a retracted orientation, attached to a vertically oriented bow.
FIG. 2 is a side view of the embodiment of the improved bow-attached, arrow launching apparatus shown in FIG. 1 wherein the apparatus is in an extended orientation prior to launching a shorter-than-conventional-length arrow.
Figure 3:
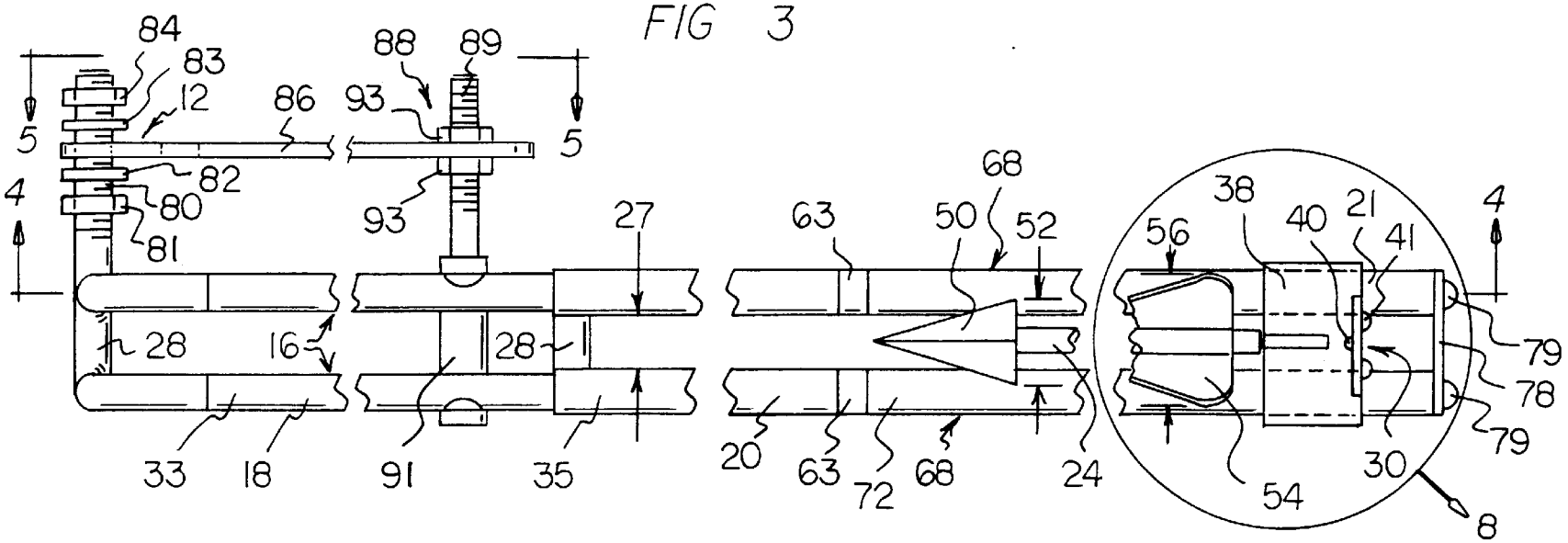
FIG. 3 is an enlarged top view of the embodiment of the improved bow-attached, arrow launching apparatus of FIG. 2 taken along line 3—3 thereof.
Figure 4:
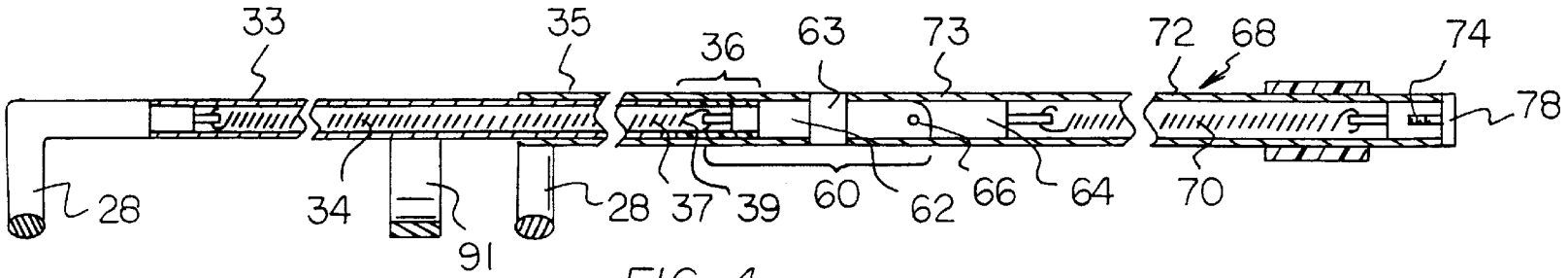
FIG. 4 is a cross-sectional view of the embodiment of the invention shown in FIG. 3 taken along line 4—4 thereof.

With reference to the drawings, a new and improved bow-attached, arrow launching apparatus embodying the principles and concepts of the present invention will be described.

Turning to FIGS. 1–8, there is shown an exemplary embodiment of the improved bow-attached, arrow launching apparatus of the invention generally designated by reference numeral 10. In its preferred form, improved bow-attached, arrow launching apparatus 10 is provided for launching an arrow 24 that has a head portion 50 which has a head width 52 and the has a tail portion 54 which has a tail width 56. The apparatus 10 includes a bow attachment assembly 12 adapted to be attached perpendicularly to a bow 14 and an arrow guide assembly 16 which includes a front end 18, a midportion 20, and a rear end 21. The front end 18 is connected to the bow attachment assembly 12 such that the arrow guide assembly 16 is oriented perpendicularly with respect to the bow attachment assembly 12. The rear end 21 is adapted to contact a bow string 22. The arrow guide assembly 16 is adapted to receive an arrow 24 for launching from the arrow guide assembly 16. The arrow guide assembly 16 includes a pair of longitudinally extensible and retractable front-end guide track assemblies located at the front end 18 of the arrow guide assembly 16. Each of the pair of longitudinally extensible and retractable front-end guide track assemblies includes a front telescopic segment 33 and a rear telescopic segment 35, adapted to be arranged in either a longitudinally retracted orientation or a longitudinally extended orientation.

A plurality of spacer supports 28 are connected to the front-end guide track assemblies and are supported by the front-end guide track assemblies a predetermined distance 27 from one another. A first spacer support 28 is connected to the bow attachment assembly 12.

A pair of transversely rotatable joint assemblies 60 are provided, wherein each joint assembly 60 includes a front joint link 62 fitted into a respective rear telescopic segment 35, and wherein each joint assembly 60 includes a rear joint link 64 and a hinge portion 66 connected between the front joint link 62 and the rear joint link 64. A first elastic resilient member 34 is connected between the front telescopic segment 33 and the front joint link 62 for urging the front telescopic segment 33 and the rear telescopic segment 35 to a retracted orientation with respect to each other. The first elastic resilient member 34 can be a first helical spring 34, pair of transversely rotatable rear-end guide track assemblies 68 are provided, wherein each rear-end guide track assembly 68 is connected to a respective joint assembly 60.

A bow string guide assembly 30 is connected between the rear-end guide track assemblies 68 at the rear end 21 of the arrow guide assembly 16. An end plate 78 can be used to secure ends of the rear-end guide track assemblies 68 together. Screws 79 can be used to secure the end plate 78 to the rear-end guide track assemblies 68. Each rear-end guide track assembly 68 includes a rear-end housing tube 72 which has an internal diameter greater than an outer diameter of the rear joint link 64, the hinge portion 66, and a portion of the front joint link 62. An end bushing 74 is attached to a rearmost end of the rear-end housing tube 72, and a second elastic resilient member 70 is disposed within the rear-end housing tube 72 and is connected between the end bushing 74 and a respective rear joint link 64. The front joint link 62 includes a stop portion 63 located between the rear telescopic segment 35 and the rear-end housing tube 72. The second elastic resilient member 70 can be a second helical spring 70.

The rear-end guide track assembly 68 can be oriented in two different modes: a folded mode, and an in-use mode. When the rear-end guide track assembly 68 is in an in-use mode, the rear-end guide track assembly 68 is in longitudinal alignment with the front-end guide track assembly. Such an in-use mode is shown in FIGS. 2, 3, 4, and 8. The folded mode is shown in FIGS. 1 and 7. To shift the rear-end guide track assembly 68 from the in-use mode to the folded mode, the following action is taken. The rear-end guide track assembly 68 is grasped and pulled longitudinally away from the bow 14. When this is done, the second elastic resilient member 70 is stretched, and one end 75 of the rear-end housing tube 72 slides longitudinally away from the stop portion 63 of the front joint link 62. When the end 75 of the rear-end housing tube 72 clears the front joint link 62 and the hinge portion 66, the pair of rear-end guide track assemblies 68 can be rotated around the hinge portion 66, such as shown in FIGS. 2 and 7. If desired, to secure the pair of rear-end guide track assemblies 68 in the folded mode, the folded rear-end guide track assemblies 68 can be tied to the bow string 22.

When it is desired to return the pair of rear-end guide track assemblies 68 to the in-use mode, the rear-end guide track assemblies 68 are rotated downward around the hinge portion 66 of the joint assembly 60. When the rear-end guide track assemblies 68 are located nearly longitudinal with respect to the rear telescopic segments 35, then the stretched second elastic resilient member 70 can relieve its stress by snapping the end 75 of the rear-end housing tube 72 back towards the front joint link 62 so that the end 75 the rear-end housing tube 72 is stopped by the stop portion 63. When, this occurs, the end 75 slides over the rear joint link 64 and the hinge portion 66, thereby locking the rear-end guide track assemblies 68 in the longitudinal orientation with respect to the rear telescopic segment 35.

The predetermined distance 27 spaced between the front-end guide track assemblies and the rear-end guide track assemblies 68 is less than the head width 52 of the head portion 50 of the arrow 24 and is less than the tail width 56 of the tail portion 54 of the arrow 24.

Each of the front-end guide track assemblies further includes a recoil spring assembly 36 connected between the first elastic resilient member 34 and the front joint link 62 of a respective joint assembly 60 for cushioning an impact between the front joint link 62 and the first elastic resilient member 34 when the rear telescopic segment 35 moves towards the front telescopic segment 33 when the telescopic segments move from a longitudinally extended orientation to a longitudinally retracted orientation. The recoil spring assembly 36 includes a cushion member 37 between a spring member 39 and the first elastic resilient member 34. The spring member 39 and the cushion member 37 absorb return forces when an arrow 24 is launched, and the rear telescopic segment 35, in an extended orientation, returns to a retracted orientation with respect to the front telescopic segment 33. The cushion member 37 can be made from well-known TEFLON(TM) material.

The bow string guide assembly 30 includes a bridge block 38 connected between the rear-end guide track assemblies 68. The bridge block 38 includes a groove 40 adapted for receiving the bow string 22. The groove 40 permits the bow string 22 to move against the bridge block 38 without being grabbed by the bridge block 38. A cover member 46 adapted to cover the groove 40 when a bow string 22 is retained in the groove 40, and Screws 41 are used to secure the cover member 46 to the bridge block 38, magnet 42 is connected to the bridge block 38. The bridge block 38 includes a pair of tube-reception channels 76 for receiving the rear-end guide track assemblies 68.

The bow attachment assembly 12 includes a threaded bolt 80, a first nut 81 and a first washer 82 placed on the threaded bolt 80, a second washer 83 and a second nut 84 placed on the threaded bolt 80. To install the bow-attached, arrow launching apparatus 10 of the invention onto a bow 14, a hole is drilled in the bow 14 perpendicular to the longitudinal axis of the bow 14. The first nut 81 and the first washer 82 are placed on the threaded bolt 80. Then, the free end of the threaded bolt 80 is inserted through the drilled hole in the bow 14. Then, the second washer 83 and the second nut 84 are placed on the threaded bolt 80. Then, the first nut 81 and the second nut 84 are screwed towards each other to sandwich the bow 14 between the first washer 82 and the second washer 83. This secures the bow-attached, arrow launching apparatus 10 onto the bow 14.

The bow attachment assembly 12 further includes a longitudinally oriented bracket member 86 supported by the threaded bolt 80, and a bracket support assembly 88 is connected to the bracket member 86. The bracket support assembly 88 includes a threaded bolt portion 89 connected to the bracket member 86 and a spacer support portion connected to the threaded bolt portion 89. A pair of nuts 93 can be used to secure the threaded bolt portion 89 to the bracket member 86.

The bow attachment assembly 12 can provide support for a rack (not shown) which can support an array of arrows 24. The spacer support portion includes a an array of arrows 24. The spacer support portion includes a U-shaped spacer strut 91 connected to the threaded bolt portion 89, and a pair of pads 92, wherein each pad 92 is connected to the U-shaped spacer strut 91 at an end portion of the U-shaped spacer strut 91. The pads 92 can be made from the well-known TEFLON(TM) material.

To launch an arrow 24, the arrow is placed on the pair of rear telescopic segments 35. The rear of the arrow 24 has a ferrous metal portion which is placed up against the magnet 42 in the bow string guide assembly 30. Then, the pair of rear-end guide track assemblies 68 is rotated downward around the hinge portion 66 so that the rear-end guide track assemblies 68 snap into a longitudinal position, this is the in-use mode. Then, the bow string 22 is pulled back away from the front of the bow 14 in the normal manner. As this is done, the arrow 24 moves back with the bow string guide assembly 30 to the position shown in FIG. 2. As the bow string guide assembly 30 is pulled back, the rear telescopic segments 35 move longitudinally away from the front of the bow 14 in a telescopic motion around the front telescopic segments 33. As this is done, the first elastic spring member 34 is stretched. When, the bow string guide assembly 30 is pulled as far back as desired, the bow string 22 is released. The tension in the bow 14 and the bow string 22 pulls the bow string guide assembly 30 forward to launch the arrow 24 from the arrow launching apparatus 10 of the invention.

Also, when the arrow 24 is launched, the first elastic spring member 34 pulls the rear telescopic segments 35 over the front telescopic segments 33. When this occurs, for each front telescopic segment 33 and for each rear telescopic segment 35, the respective cushion member 37 and the respective spring member 39 cushions recoil between the front telescopic segment 33 and the rear telescopic segment 35. Another arrow 24 can be removed from the bow attachment assembly 12, and the launching steps can be repeated.

The components of the improved bow-attached, arrow launching apparatus of the invention can be made from inexpensive and durable metal and plastic materials.

As to the manner of usage and operation of the instant invention, the same is apparent from the above disclosure, and accordingly, no further discussion relative to the manner of usage and operation need be provided.

It is apparent from the above that the present invention accomplishes all of the objects set forth by providing a new and improved bow-attached, arrow launching apparatus that is low in cost, relatively simple in design and operation, and in which a first determiner of overall length is provided by the relationship between two telescopic members, and a second determiner of overall length is provided by the length of the folding rear-end guide track assembly. With the invention, an improved bow-attached, arrow launching apparatus is provided in which a bracket member can be used as a support for a plurality of arrows.

Thus, while the present invention has been shown in the drawings and fully described above with particularity and detail in connection with what is presently deemed to be the most practical and preferred embodiment(s) of the invention, it will be apparent to those of ordinary skill in the art that many modifications thereof may be made without departing from the principles and concepts set forth herein, including, but not limited to, variations in size, materials, shape, form, function and manner of operation, assembly and use.

Hence, the proper scope of the present invention should be determined only by the broadest interpretation of the appended claims so as to encompass all such modifications as well as all relationships equivalent to those illustrated in the drawings and described in the specification.

Finally, it will be appreciated that the purpose of the foregoing Abstract provided at the beginning of this specification is to enable the U. S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

What is claimed as being new and desired to be protected by Letters Patent of the United States is as follows:

1. A bow-attached, arrow launching apparatus for launching an arrow that has a head portion having a head width and that has a tail portion having a tail width, comprising:

a bow attachment assembly adapted to be attached perpendicularly to a bow, and an arrow guide assembly which includes a front end, a midportion, and a rear end, wherein said front end is connected to said bow attachment assembly such that said arrow guide assembly is oriented perpendicularly with respect to said bow attachment assembly, wherein said rear end is adapted to contact a bow string, wherein said arrow guide assembly is adapted to receive an arrow for launching from said arrow guide assembly, wherein said arrow guide assembly includes, a pair of longitudinally extensible and retractable front-end guide track assemblies located at said front end of said arrow guide assembly, wherein each of said pair of longitudinally extensible and retractable front-end guide track assemblies includes a front telescopic segment and a rear telescopic segment, adapted to be arranged in either a longitudinally retracted orientation or a longitudinally extended orientation, a plurality of spacer supports connected to said front-end guide track assemblies and supported by said front-end guide track assemblies a predetermined distance from one another, wherein a first spacer support is connected to said bow attachment assembly, a pair of transversely rotatable joint assemblies, wherein each joint assembly includes a front joint link fitted into a respective rear telescopic segment, and wherein each joint assembly includes a rear joint link and a hinge portion connected between said front joint link and said rear joint link, a first elastic resilient member connected between said front telescopic segment and said front joint link for urging said front telescopic segment and said rear telescopic segment to a retracted orientation with respect to each other, a pair of transversely rotatable rear-end guide track assemblies, wherein each rear-end guide track assembly is connected to a respective joint assembly, and a bow string guide assembly connected between said rear-end guide track assemblies at said rear end of said arrow guide assembly.

2. The apparatus of claim 1 wherein each rear-end guide track assembly includes:

a rear-end housing tube which has an internal diameter greater than an outer diameter of said rear joint link, said hinge portion, a portion of said front joint link, an end bushing attached to a rearmost end of said rear-end housing tube, and a second elastic resilient member disposed within said rear-end housing tube and connected between said end bushing and a respective rear joint link.

wherein said front joint link includes a stop portion located between said rear telescopic segment and said rear-end housing tube.

3. The apparatus of claim 1 wherein said predetermined distance spaced between said front-end guide track assemblies and said rear-end guide track assemblies is less than the head width of the head portion of the arrow and is less than the tail width of the tail portion of the arrow.

4. The apparatus of claim 1 wherein each of said front-end guide track assemblies further includes:

a recoil spring assembly connected between said first elastic resilient member and said front joint link of a respective joint assembly for cushioning an impact between said front joint link and said first elastic resilient member when said rear telescopic segment moves towards said front telescopic segment when said telescopic segments move from a longitudinally extended orientation to a longitudinally retracted orientation.

5. The apparatus of claim 4 wherein said recoil spring assembly includes a cushion member between a spring member and said first elastic resilient member.

6. The apparatus of claim 1 wherein said bow string guide assembly includes:

a bridge block connected between said rear-end guide track assemblies, wherein said bridge block includes a groove adapted for receiving the bow string, wherein said groove permits the bow string to move against said bridge block without being grabbed by said bridge block, a cover member adapted to cover said groove when a bow string is retained in said groove, and a magnet connected to said bridge block.

7. The apparatus of claim 6 wherein said bridge block includes a pair of tube-reception channels for receiving said rear-end guide track assemblies.

8. The apparatus of claim 1 wherein said bow attachment assembly includes:

a threaded bolt, a first nut and a first washer placed on said threaded bolt, a second washer and a second nut placed on said threaded bolt.

9. The apparatus of claim 8 wherein said bow attachment assembly further includes:

a longitudinally oriented bracket member supported by said threaded bolt, and a bracket support assembly connected to said bracket member, wherein said bracket support assembly includes a threaded bolt portion connected to said bracket member and a spacer support portion connected to said threaded bolt portion.

10. The apparatus of claim 1 wherein one of said spacer support portions includes:

a U-shaped spacer strut connected to said threaded bolt portion, and a pair of pads, wherein each pad is connected to said U-shaped spacer strut at an end portion of said U-shaped spacer strut.

* * * * *